US005806421A

United States Patent [19]

Dolan et al.

[11] Patent Number: 5,806,421

[45] **Date of Patent: *Sep. 15, 1998**

[54] METHOD AND APPARATUS FOR SECURELY PRINTING A MACHINE DETECTABLE POSTAL INDICIA IMAGE

[75] Inventors: Donald T. Dolan, Ridgefiled; Joseph L. Gargiulo, Trumbull; David W. Hubbard, Stamford; Charles F. Murphy, III, Milford, all of Conn.

[73] Assignee: Pitney Bowes Inc., Stamford, Conn.

[ * ] Notice: The term of this patent shall not extend beyond the expiration date of Pat. No. 5,762,428.

[21] Appl. No.: 579,501

[22] Filed: Dec. 27, 1995

[51] Int. Cl.[6] ..... B41J 2/07

[52] U.S. Cl. ..... 101/93.01; 395/108; 400/124.05; 101/93; 101/93.04

[58] Field of Search ..... 101/91, 93, 92, 101/93.04, 93.05, 93.01; 400/124.04, 124.05, 124.27; 395/108, 109, 110

[56] References Cited

U.S. PATENT DOCUMENTS

| | | | |
|---|---|---|---|
| 4,743,127 | 5/1988 | Uematsu | 395/108 |
| 4,809,082 | 2/1989 | Yamaguchi et al. . | |
| 4,855,752 | 8/1989 | Bergstedt . | |
| 4,967,203 | 10/1990 | Doan et al. . | |
| 4,999,646 | 3/1991 | Trask . | |
| 5,070,345 | 12/1991 | Lahut et al. . | |
| 5,330,276 | 7/1994 | Tanida | 395/108 |
| 5,347,617 | 9/1994 | Webb et al. . | |
| 5,467,709 | 11/1995 | Solomon | 101/93 |

FOREIGN PATENT DOCUMENTS

| | | |
|---|---|---|
| 56-8273 | 1/1991 | Japan . |

*Primary Examiner*—Christopher A. Bennett
*Attorney, Agent, or Firm*—Steven J. Shapiro; Melvin J. Scolnick

[57] ABSTRACT

A method for printing a postal indicia on a mailpiece includes moving a printing mechanism and the mailpiece relative to each other during a plurality of passes; and printing with the printing mechanism at least a corresponding portion of the postal indicia during each of the plurality of passes, each of the corresponding portions being in overlapped relationship to the other corresponding portions so that the combined effect of the corresponding overlapped portions is a postal indicia which is detectable by a facer/canceler machine as a valid postal indicia. Furthermore, during no more than one of the plurality of passes is its corresponding portion of the postal indicia detectable by the facer/canceler machine as the valid postal indicia. An apparatus incorporates the above method.

11 Claims, 8 Drawing Sheets

METHOD AND APPARATUS FOR SECURELY PRINTING A MACHINE DETECTABLE POSTAL INDICIA IMAGE

BACKGROUND

This invention relates to printing an image with multiple passes of a printing mechanism and more particularly relates to securely printing a machine detectable postal indicia image utilizing multiple passes of a printing mechanism relative to a mailpiece.

Traditional postage meters imprint an indicia on a mailpiece or a label to be subsequently placed on a mailpiece as evidence that postage has been paid. These traditional postage meters create the indicia using a platen/ink die combination or a rotary drum/impression roller combination which are moved into contact with the mailpiece to print the indicia thereon. While traditional postage meters have performed admirably over time, they are limited by the fact that if the indicia image significantly changes, a new die or rotary drum will have to be produced and placed in each meter. Accordingly, newer postage meters now take advantage of modern digital printing technology to overcome the deficiencies of traditional meters. The advantage of digital printing technology is that since the digital printhead is software driven, all that is required to change an indicia image is new software. Thus, the flexibility in changing indicia images or adding customized advertising slogans is significantly increased.

Modern digital printing technology includes thermal ink jet (bubble jet), piezoelectric ink jet, thermal transfer printing, and LED and laser xerographic printing which all operate to produce images in a dot-matrix pattern. In dot-matrix ink jet printing, individual print elements in the printhead such as resistors or piezoelectric elements are either electronically stimulated or not stimulated to expel or not expel, respectively, drops of ink from a reservoir onto a substrate. By controlling the timing of the energizing of each of the individual print elements in conjunction with the relative movement between the printhead and the mailpiece, a dot-matrix pattern is produced in the visual form of the desired postage indicia image.

With regard to a postage indicia, there is a need to produce an indicia image which is visually appealing and clearly readable. The indicia image must have a relatively high optical density. That is, the density of the individual dots produced by the printhead must be sufficiently high. Moreover, it is desirable that the optical density of the indicia image is sufficient enough so that the indicia image is readable using conventional optical character reader (OCR) equipment. Furthermore, when a mailpiece having an indicia image thereon is processed by, for example, the United States Postal Service (USPS), it must be detected by a conventional facer/canceler machine in order to distinguish it from both stamped mailpieces and mailpieces without a stamp or indicia thereon. The facer/canceler machine typically detects a mailpiece having an indicia by exposing the printed indicia to ultraviolet lamps and then measuring the amount of radiated light emitted back by the indicia ink. If the measured radiated light exceeds a predetermined level, the mailpiece is identified as an indicia (metered mail) and is subsequently processed to an appropriate station for further handling. It is to be noted that in the United States the indicia ink is a fluorescent ink. However, in other countries the indicia ink may be a phosphorescent ink which also emits radiated light when exposed to ultraviolet lamps such that these phosphorescent indicia can also be identified by detecting the amount of radiated light emitted therefrom. Therefore, if an indicia image is to be produced digitally in a dot-matrix pattern, the density of the individual ink dots must be sufficient to allow the fluorescence (or phosphorescence) of the indicia ink to be detected by the facer/canceler as discussed above.

In producing a dot-matrix image using a digital printhead, the individual dots in the matrix are often defined according to their relative density in two directions. That is, the dots will have a certain density (expressed as dots per inch (dpi))) in the direction of relative movement between the printing mechanism and the recording medium as well as a density in a direction perpendicular thereto, which perpendicular density is a function of the pitch (spacing) between each of the individual nozzles in the printhead. In the case of a very simple printhead having a single row of nozzles, the density of the dot-matrix pattern in the direction of relative movement between the printhead and the recording medium is dependent upon the speed of the relative movement between the printhead and the recording medium and the frequency at which the nozzles are energized. In the direction perpendicular to the relative movement, if a desired high dot density is required, the pitch between individual nozzles in the row of nozzles has to be precisely defined to result in the desired dot density. That is, the density of the nozzles themselves must be very high. As an alternative to using a printhead having a high nozzle density, a printhead could be used having two adjacent rows of nozzles that are offset from each other to obtain the desired dot density in the direction perpendicular to the relative movement of the printhead and recording medium. In this printhead configuration, the energizing timing of the nozzles in the two adjacent rows would have to be delayed relative to each other to allow individual columns of the indicia image to be created with the desired dot density. In yet another alternative, a plurality of printheads which are appropriately aligned could also be utilized to produce the desired dot density.

Each of the above-mentioned ways of producing the indicia image has serious limitations. With respect to using a single printhead having only a single row of nozzles, the complexity of producing a printhead which has the required nozzle density and is capable of printing the full height of the indicia image in a single pass of the printhead significantly drives up the cost of the printhead due to the complexity of manufacturing such a printhead which results in low manufacturing yields. In the case of using two adjacent rows of nozzles which are offset from each other, the manufacturing costs associated therewith is also relatively high and additional complexity is added to the meter electronics in order to control the delayed energizing of each of the nozzles in each of the rows to accurately produce the image without any noticeable shift in or misalignment of the indicia image. Finally, if a plurality of aligned printheads are used, the overall cost of the printing mechanism is obviously increased since two printheads are required versus one. Furthermore, as in the case of the adjacent rows of nozzles discussed above, the complexity of the electronics is increased to control the energizing sequence of the nozzles in the two printheads.

The Applicants of the instant invention have recognized the deficiencies associated with each of the above approaches, particularly with respect to producing a low cost postage meter for use in the home, small office, or home office environments. Accordingly, the Applicants embarked upon an approach to utilize a commercially available low cost printhead having a single row of nozzles which produces a relatively low dot density in the direction of the row. The low cost printhead produced the desired density indicia image by making multiple overlapping passes of the printhead. The printhead selected included a single row of 64 nozzles which when arranged transversely to the relative movement between the mailpiece and the printhead is capable of producing in a single pass a 0.8 inch high indicia at a resolution of 80 dots per inch (dpi) along the height of the indicia (perpendicular to the relative movement of the printhead and the mailpiece). However, since a greater dpi is desired along the height of the indicia image in order to ensure that it is detectable by a facer/canceler machine and preferably OCR readable, the printhead (or mailpiece) is shifted, after the first pass, along the height of the indicia such that during a second pass of the printhead a second indicia image identical to or substantially the same as the first indicia image is interlaced with the first indicia image to produce a combined indicia image having a density of 160 dpi along its height. Moreover, additional interlaced passes of the printhead can be performed in order to further increase the desired indicia height density, such as a third pass to produce a height density of 240 dpi. The shifting of the printhead along the indicia height is usually a fraction of the nozzle pitch, the fraction varying with the number of passes (½ for two passes, ⅓ for three passes, etc).

While the above solution by the Applicants allowed for the use of a low cost commercially available printhead in a postage meter for producing an indicia of an acceptable indicia height density, a potential security problem existed in that during each pass of the printhead a complete human readable indicia having an indicia height resolution of 80 dpi is produced. Thus, if three envelopes were inserted one on top of the other and then removed one at a time after each pass of the printhead, each envelope would have a readable indicia while the postage meter would only have accounted for the cost of one indicia. It is possible that despite the fact that each of these low density indicias would not be detected by the facer/canceler and would thus be appropriately routed for visual inspection by a postal worker, the quality of the indicia produced could still be mistaken as being a valid indicia during the visual inspection. Moreover, depending upon the density of the image produced during the three passes, it was also possible that each of the three images would be identified by a facer/canceler machine as a valid indicia.

In view of the above, the Applicants recognized that a more secure way of printing a desired density indicia is required which would still permit the use of commercially available low cost/low density printheads. The instant invention is directed toward the method and apparatus associated therewith.

SUMMARY OF THE INVENTION

The instant invention is directed to a method and apparatus for securely printing a postal indicia that permits use of low cost printing technology. The method includes moving a printing mechanism and a mailpiece relative to each other during a plurality of passes; and printing with the printing mechanism at least a corresponding portion of the postal indicia during each of the plurality of passes, each of the corresponding portions being in overlapped relationship to the other corresponding portions so that the combined effect of the corresponding overlapped portions is a postal indicia which is detectable by a facer/canceler machine as a valid postal indicia. Furthermore, during no more than one of the plurality of passes is its corresponding portion of the postal indicia detectable by the facer/canceler machine as the valid postal indicia. The apparatus incorporates the above method.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

DETAILED DESCRIPTION OF THE PREFERRED EMBODIMENTS

Figure 1:
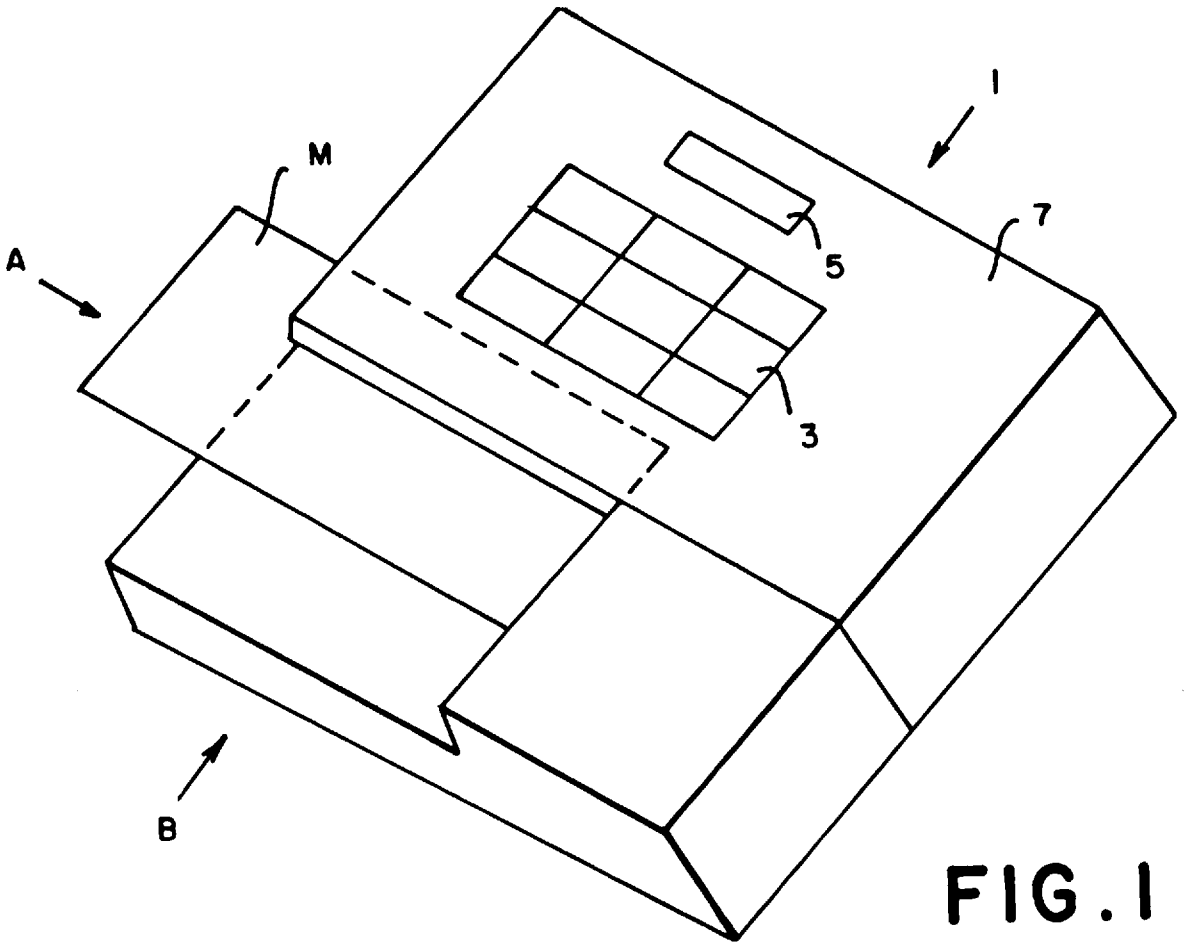
FIG. 1 is a perspective view of a postage meter incorporating the claimed invention.

Referring to FIG. 1, there is shown a new low cost postage meter 1 having a very small footprint and intended for use in the home or small business environment. Mailpieces "M"(which for the purposes of this application include envelopes, labels, flats, etc.) are fed to the postage meter 1 in either the direction of arrows "A" or "B" until a sensor (not shown), such as a microswitch, is activated by the mailpiece "M" thereby identifying the presence of the mailpiece "M". Upon identification of the mailpiece "M", a printing mechanism 9 (see FIG. 2) moves across the stationary mailpiece "M" to print the indicia image as will be discussed in more detail below. Prior to printing, the operator will have entered the postage required via individual keypad buttons 3 and the electronics in the low cost meter will have verified that a particular postage transaction is permissible. Thus, once the transaction has been authorized, detection of the mailpiece "M" by the microswitch triggers movement of the printing mechanism 9. As noted in FIG. 1, a display 5 is disposed in a top cover portion 7 of postage meter 1. The display 5 permits the postage meter 1 to visually prompt any required input by the operator and to display the operator's input which has been entered through the keypad buttons 3.

Figure 2:
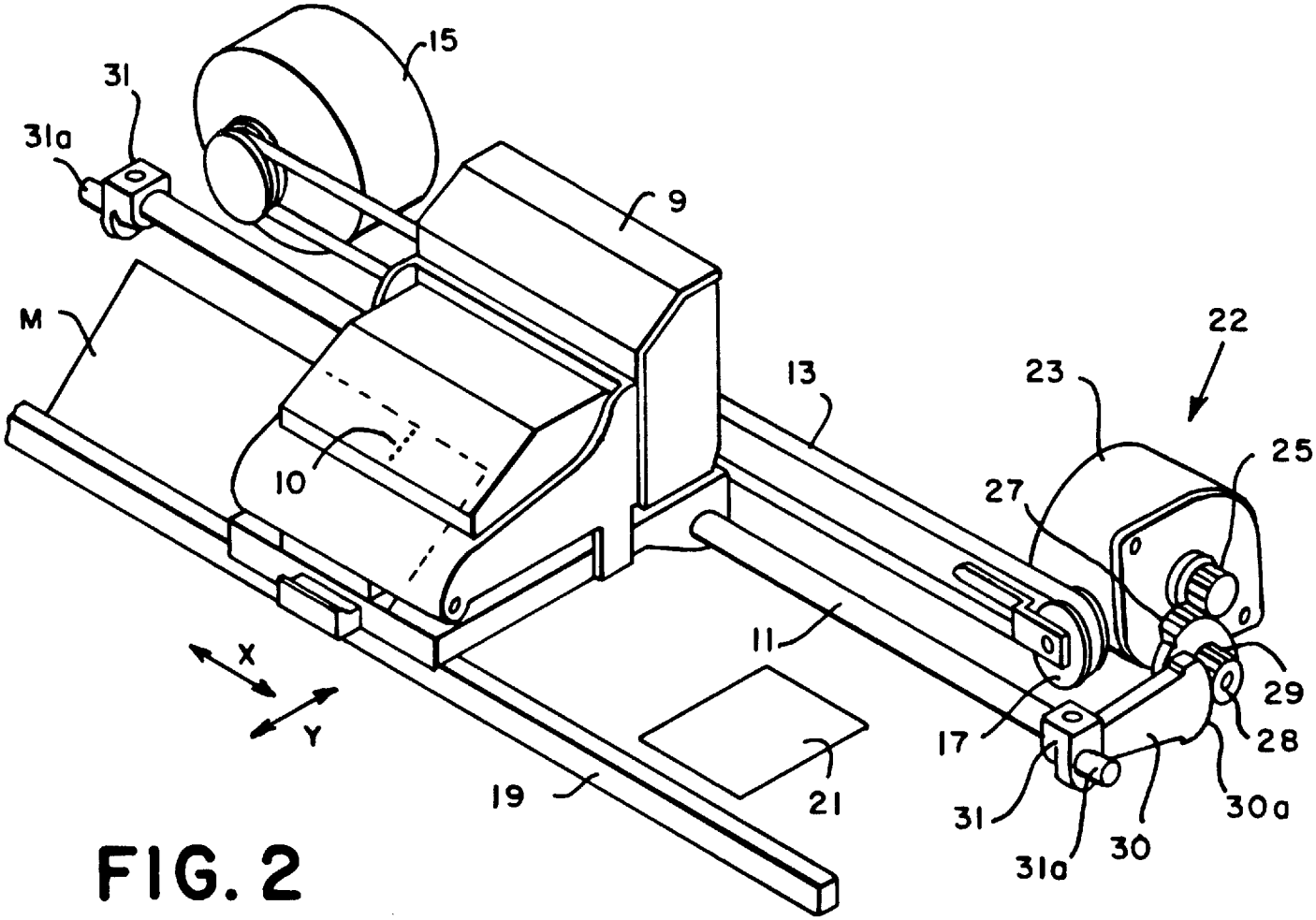
FIG. 2 is a perspective view of the structure for moving the printing mechanism within the postage meter of FIG. 1.

Regarding the movement of the printing mechanism across the mailpiece "M" reference is made to FIG. 2. FIG. 2 shows a portion of the postage meter 1 which is housed under cover 7 and which permits movement of printing mechanism 9 in the directions of arrows "X" and "Y". Printing mechanism 9 is preferably an ink jet printer having a single row of nozzles 10 arranged transversely to the direction of arrow "X". However, any dot matrix producing printer could be used. Printing mechanism 9 is rotatably mounted on a guide bar 11 and connected to an endless belt 13 driven into rotation by a motor 15. Thus, via the movement of the motor 15 and belt 13, printing mechanism 9 is capable of being moved in a reciprocating manner between the motor 15 and an idler pulley 17. Moreover, the front end of printing mechanism 9 rests on a fixed support surface 19 and slides there along. A maintenance station is shown schematically at 21. The maintenance station 21 is a conventional structure at which purging, wiping and sealing of the nozzles 10 occurs during moments of non-printing. Printing mechanism 9 is positioned at the maintenance station 21 when not being utilized for printing. Thus, when the microswitch detects the presence of the mailpiece "M" in the postage meter 1, a postage meter microcontroller 43 (see FIG. 3) controls the operation of motor 15 to move printing mechanism 9 from maintenance station 21 and across the face of mailpiece "M" to print the postage indicia thereon.

As previously discussed, and in order to make use of a printing mechanism 9 which is a low cost/low nozzle density unit, a plurality of passes of printing mechanism 9 over mailpiece "M" is required in order to produce a postage indicia image having an acceptable density in both the "X" and a "Y" directions. The density of the dots in the "X" direction is easily controlled, via the microcontroller 45 (see FIG. 3), by coordinating the movement of printing mechanism 9 via motor 15 in the "X" direction together with the firing frequency of the individual nozzles 10. That is, the slower printing mechanism 9 is moved in the "X" direction for a given nozzle 10 firing frequency, the greater the dot density will be in that direction. With regard to the "Y" direction, printing mechanism 9 must be shifted in the Y direction after each pass of printing mechanism 9 in the "X", direction in order to increase the dot density of the produced indicia image along the "Y" direction.

The preferred structure for moving printing mechanism 9 in the "Y" direction is shifting mechanism 22 which includes a motor 23 operatively engaged to rotate a first gear 25 in either direction, a gear segment 27 which is intermeshed with first gear 25 and fixedly mounted on a shaft 28 that is rotatably mounted in a conventional manner in the postage meter 1, a second gear 29 fixedly mounted on shaft 28, a shift arm 30 having teeth 30*a* which are intermeshed with gear 29, and an L-shaped housing structure 31 which is mounted for rotation in a conventional manner in postage meter 1 and in which guidebar 11 is eccentrically disposed relative to the center line of a hub portion 3*la* of housing 31. In a preferred embodiment, housing 31 is a single molded component including shift arm 30. The shifting mechanism 22 works as follows. Once the first pass of printing mechanism 9 in the "X" direction is completed, and it returns to its initial position, motor 23 causes a rotation of housing 31 and shift arm 30 via the gear train 25, 27, 29 and 30*a*. The rotation of housing 31 causes a corresponding movement of guide rod 11. However, since guide rod 11 is eccentrically mounted relative to the center line of hub 31*a* (around which housing 31 is forced to rotate) it moves along an arc such that there is a movement of printing mechanism 9 predominately in the "Y" direction. The gear train is designed such that the amount of movement in the "Y" direction is a function of the spacing between the nozzles 10 and the number of passes of printing mechanism 9 to be made as previously discussed. It should be noted that since the printing mechanism 9 is free to rotate about guide rod 11 while resting on support 19, any upward or downward movement of guide rod 11 is negligible. It is also to be noted that the opposite end of guide rod 11 is mounted in an identical housing 31 which is rotatably mounted in the main side frame of postage meter 1.

Figure 3:
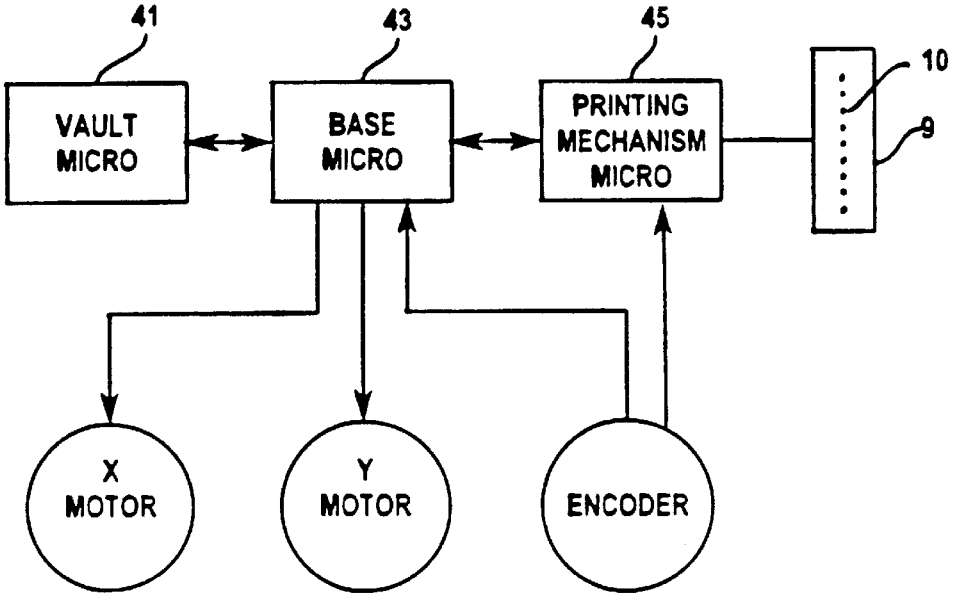
FIG. 3 is a schematic block diagram of the control system of the postage meter of FIG. 1.

While the synchronization of the moving of printing mechanism 9 with the energizing of nozzles 10 is well known in the art, a brief schematic overview of a postage meter architecture utilizing such principles is shown in FIG. 3. The postage meter 1 includes a vault microprocessor 41, a base microprocessor 43, and a printing mechanism microprocessor 45. Vault microprocessor 41 perform funds accounting, while base microprocessor 43 manages the message interaction between the operator and the postage meter 1 via display 5. In addition, base microprocessor 43 acts as a communication channel between vault microprocessor 41 and printing mechanism microprocessor 45. Postage meter 1 also includes a conventional encoder 47 which provides a signal indicating the "X" position of printing mechanism 9. The encoder signal is used by base microprocessor 43 to control operation of the motors 15, 23 and is used by printing mechanism 45 to synchronize energizing of nozzles 10 with the movement of printing mechanism 9.

Figures 4A, 4B, 4C:
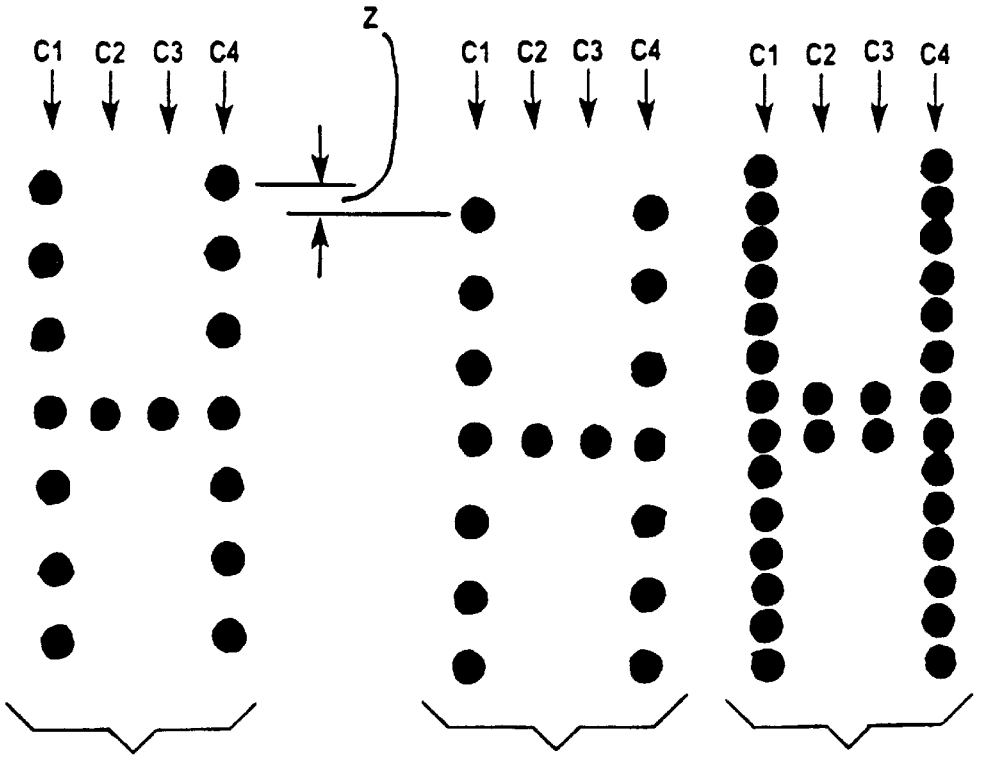
FIGS. 4(*a*), (*b*), and (*c*) together show the printing sequence of a representative indicia character.

Referring to FIGS. 4(*a*), 4(*b*) and 4(*c*) there is shown in an enlarged view the steps for printing a single letter at a desired vertical dot density utilizing a printing mechanism 9 having a low nozzle density. FIG. 4(*a*) shows the results of a single pass of printing mechanism 9 in producing the letter "H". That is, assuming printing mechanism 9 is moving from left to right in FIG. 4(*a*), it can be energized in a known manner as it moves to produce the letter "H". Assuming, for example and ease of explanation, that there is only a single row of 7 nozzles 10 in printing mechanism 9 and the speed of printing mechanism 9 has been coordinated with the frequency of firing of the nozzles 10 such that individual nozzles 10 are energized when printing mechanism 9 is at any of the column 3 positions C1, C2, C3, and C4. The letter "H" is produced by energizing all of the nozzles 10 when the printing mechanism is at column Cl, energizing only the fourth or middle nozzle 10 when the printing mechanism is at columns C2 and C3 and lastly energizing all of the nozzles 10 when the printing mechanism 9 is in the position of column 3 C4. The letter "H" produced during this first pass of printing mechanism 9 has a low dot density. That is, the dots in the vertical or height direction of the letter "H" are fairly well spaced apart such that a large amount of the white background of the paper shows through. In order to improve the visual quality of the letter "H", in this example, a second pass of printing mechanism 9 is made which is complementary in nature to the first pass. That is, during a second pass of printing mechanism 9, in either the left to right or right to left directions, an identical image of the letter "H" can be produced. The only difference between the first and second letter "H" images is that during the second pass printing mechanism 9 is shifted down by ½ of the pitch of the vertical spacing between individual nozzles 10 and therefore correspondingly ½ of the spacing between the ink dots of the first image. During the second pass of printing mechanism 9 the nozzles 10 will still be controlled to be energized at columns C1, C2, C3, and C4 just as they were during the first pass such that the dot density in the direction of movement of printing mechanism 9 will not be changed. FIG. 4(*b*) shows that the letter "H" produced during the second pass is shifted by ½ the center to center vertical spacing "Z" of the dots of the first image "H". While FIGS. 4(*a*) and 4(*b*) have been shown separately to identify exactly what image is produced during each of the first and second passes of printing mechanism 9, FIG. 4(*c*) shows the finally produced image "H" which is an interlaced combination of the individual "H's" formed during the first and second passes of printing mechanism 9. It is quite clear that the finally produced image "H" has a dot density in the vertical direction which is twice as much as the vertical dot density individually produced during either the first or second passes of printing mechanism 9.

As previously stated, this procedure can be repeated for additional passes of printing mechanism 9 to further increase the dot density of the finally produced image in the vertical or height direction of the image. Thus, for example, if the finally produced "H" required 3 passes of printing mechanism 9, prior to the second pass printing mechanism 9 would be shifted along the height of the image by ⅓ of the pitch of the nozzles 10 and prior to the third pass printing mechanism 9 would be shifted again by ⅓ of the pitch of nozzles 10 relative to the position of printing mechanism 9 during the second pass thereof.

Figure 5:
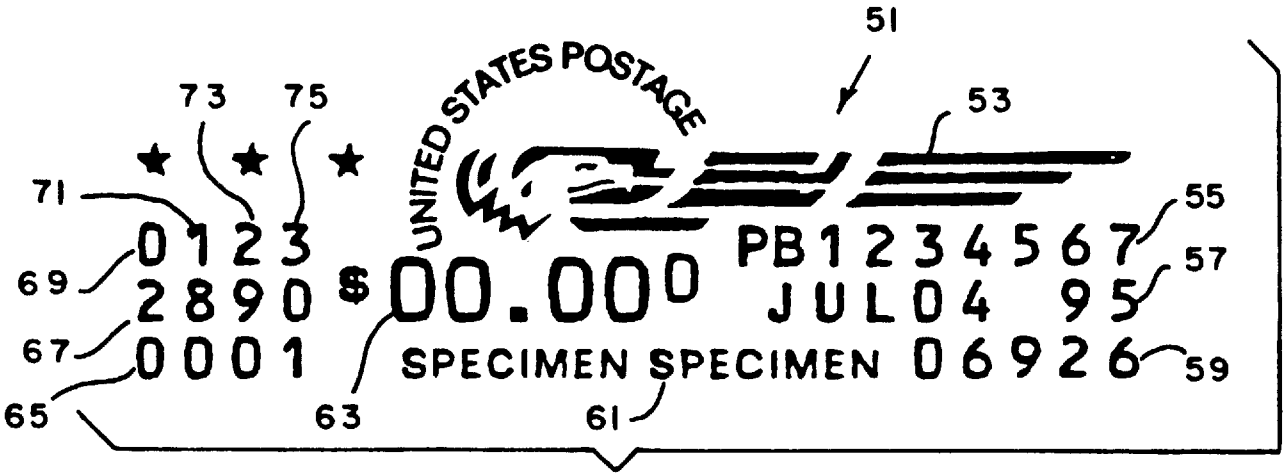
FIG. 5 shows a representative indicia produced by the method of FIG. 4.

While the above description, for simplicity, was only applied to the printing of a single letter, the Applicants have applied this basic principle to produce a full postal indicia image. FIG. 5 shows an enlarged representative example of a typical postage indicia which can be printed by postage meter 1 for use in the United States. The postage indicia 51 includes a graphical image 53 including the 3 stars in the upper left hand corner, the verbiage "UNITED STATES POSTAGE", and the eagle image; a meter identification number 55; a date of submission 57; the originating zip code 59; the originating post office 61, which for the ease of simplicity is just being shown with the words "SPECIMEN SPECIMEN"; the postage amount 63; a piece count 65; a check digits number 67; a vendor I.D. number 69; a vendor token 71; a postal token 73; and a multipass check digit 75. While most of the portions of the indicia image 51 are self explanatory, a few require a brief explanation. The vendor I.D. number identifies who the manufacturer of the meter is, the vendor token and postal token numbers are encrypted numbers which can be used by the manufacturer and post office, respectively, to verify if a valid indicia has been produced, and the multipass check digit number will be discussed in more detail below.

The FIG. 5 indicia is simply a representative example and the information contained therein will vary from country to country. In the context of this application the terms indicia and indicia image are being used to include any specific requirements of any country.

As previously mentioned, the Applicants initially utilized a 3 pass approach as described above in connection with FIG. 4 for producing the indicia 51. In their initial experiments, the Applicants utilized a printing mechanism 9 having a single column of nozzles which were capable of producing a dot density of 80 dpi. The drop size from each nozzle was approximately 50 pico liters resulting in an average ink dot size deposited on the paper of 4.2 mils in diameter. Thus, for a single column produced by the nozzles 10, approximately ⅔ of the swath area would be ink free. Therefore, to get as close as possible to producing in each column a solid line, three passes of printing mechanism 9 were made in an interlaced relationship to each other. Thus, during a single pass of printing mechanism 9 from either the right to left or left to right direction as viewed in FIG. 5, the first pass of printing mechanism 9 produced the indicia image 51 having an indicia height dot density of 80 dpi. Moreover, the movement of printing mechanism 9 was synchronized with the firing frequency of nozzles 10 to produce a density along the length of the indicia image 51 of 240 dots per inch. During the second and third passes of the printing mechanism 9 over the area covered by the indicia 51, printing mechanism 9 was shifted by ⅓ the pitch density of the nozzles 10 to produce a final indicia image 51 which was the combination of 3 interlaced full indicia images. The finally produced indicia image 51 has a height of 0.8 inches, a dot density of 240 dpi in the height direction of the indicia and a corresponding dot density of 240 dpi in the length direction. Moreover, the indicia image printed during each pass visually appear as an indicia image 51 but they can be either identical to each other or have slightly different dot patterns depending on how the final combined indicia 51 is required to look.

While the above method produces the indicia 51 which is capable of being read by OCR equipment as well as being detected by the facer/canceler machine, a potential security problem exists in that if someone stacked three envelopes in the postage meter 9 and pulled one envelope after each pass of printing mechanism 9, three envelopes would be produced each having an indicia image 51 of 240 dpi by 80 dpi. While the density of these individual indicia images would not likely be detected by the facer/canceler machine or be readable by OCR equipment, a risk still exists that all 3 envelopes could be used while the postage meter 1 only accounted for printing of a single indicia. That is, even if the facer/canceler machine did not detect the indicia, the envelopes would simply be passed to another station for a visual inspection. It is quite possible that during the visual inspection the 80 by 240 dpi indicia could be considered as a valid indicia. This security risk is considered unacceptable.

The above situation created a significant problem for the Applicants in their effort to produce a low cost postage meter 1 utilizing a low cost printing mechanism having a single column of nozzles which could print a postage indicia of a desired dot density through the multiple pass technique set forth above. The alternative solutions of using multiple printheads and printheads having multiple nozzle arrays to produce the desired dot density in a single pass significantly drives up the cost of postage meter 1 defeating a major objective of producing a low cost meter 1.

Figure 6A:
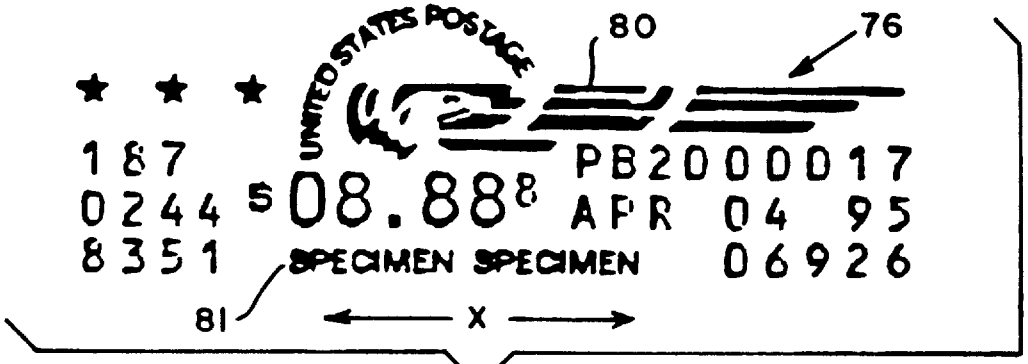
FIGS. 6(*a*), (*b*), and (*c*) together show a first method for printing a secure indicia including an enhancement pass.
Figure 6B:
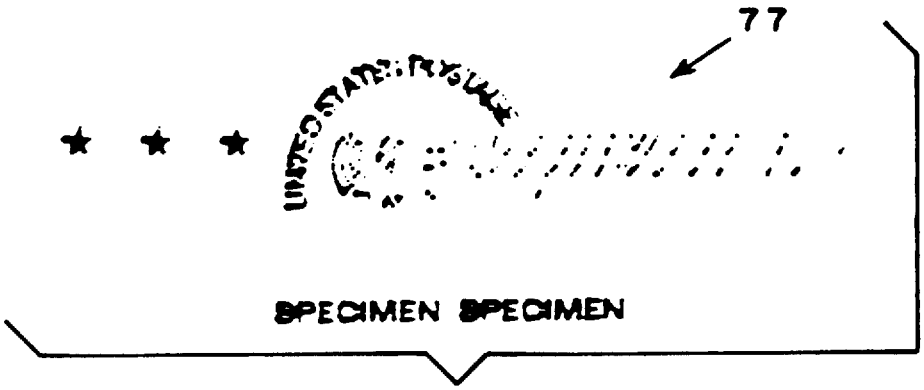
Figure 6C:
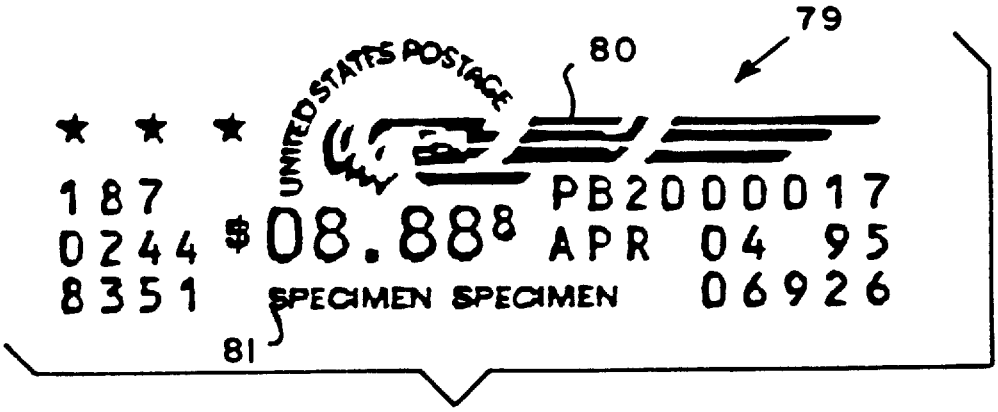

A first method of printing which overcomes the security problem discussed above is described in connection with FIG. 6(*a*), 6(*b*), and 6(*c*). This method produces a final indicia image utilizing only two passes of printing mechanism 9. Referring to FIG. 6(*a*), during a first pass of printing mechanism 9 a complete low dot density indicia 76, of a single color ink including both numerics and fixed graphics, is formed on a mailpiece (not shown) at an indicia height resolution of 80 dpi. During this first pass of printing mechanism 9 along the "X" direction the indicia image 76 is formed in a first "Swath" of printing mechanism 9 which is defined as being the area covered by nozzles 10 during the first pass. The density of the dots along the length of the indicia 76 may vary, but a preferred resolution is 480 dpi or greater. Thus, during this first pass of printing mechanism 9 the indicia image 76 is produced which may or may not have an overall dot density in both its length and height directions which would allow it to be detectable by a facer/ canceler machine.

Prior to a second pass of printing mechanism 9, it is shifted along the height of the indicia by ½ the pitch of nozzles 10. Thus, during the second pass of printing mechanism 9 in either the left to right or right to left direction along the length of indicia 76, a second image 77 is produced that is interlaced with the first indicia image 76 since the first and second swaths substantially overlap each other. The dot density along the length of the second image 77 is the same as that of the first indicia image 76. The second image 77, which is a preselected portion of the first indicia image 76, is shown in FIG. 6(*b*) and the interlaced combination of FIGS. 6(*a*) and 6(*b*) produces a final indicia image 79 as shown in FIG. 6(*c*). Thus, during the second pass, additional dots (pixels) are placed within the graphical image 80 and the originating post office area 81 to enhance the overall quality of the indicia image 76 produced during the first pass. In particular, the areas with very small detail such as "United States Postage" and the body of the eagle have additional pixels added thereto to "clean up"the image. The combination of the second or "enhancement pass" with the image 76 produces the final indicia image 79 of FIG. 6(*c*) which has an overall dot density that permits detection and sorting by a facer/ canceler machine. The final indicia image 79 consists of portions having an indicia height density of 160 dpi and portions having an indicia height density of 80 dpi, whereas the dot density along the length of the indicia can, for example, be 480 dpi or as discussed above.

An important feature of the above method is that only during the first pass of printing mechanism 9 is an image produced which, when viewed by an individual, is recognizable as an indicia. The second pass of printing mechanism 9 produces an image which is not detectable by the facer/canceler machine as an indicia and is clearly not recognizable by an individual as an indicia. Accordingly, even if someone were to stack 2 envelopes in postage meter 1 and remove one after the first pass, only 1 of the envelopes would have an indicia thereon that might be visually recognized as a valid indicia. Moreover, based on the above concept, one skilled in the art will recognize that the dot density of the indicia image 76 produced during the first pass can be varied in the indicia length direction such that the indicia 76 is not detectable by a facer/canceler machine. In this situation, even though an individual could not produce 2 indicia for the price of 1, if they attempted do this and only used the mailpiece having the indicia 76 produced by the first pass alone, there is a good chance that the postal service could detect the fraudulent attempt on the part of the operator because the single pass indicia 76 would be sorted for visual inspection where its poor quality could possibly be detected.

A further variation of the method described in connection with FIGS. 6(*a*), 6(*b*), and 6(*c*) is that in addition to adding the "touch-up" pixels to the graphics image 53, additional touch up pixels could be added during the second pass of the printing mechanism 9 to the numerics of the indicia 76 so as to improve the quality of the image and still obtain OCR readability of the numerics. Once again, the added numeric pixels would be limited so that during the second pass a visually recognizable indicia image would not be printed.

Figure 7A:
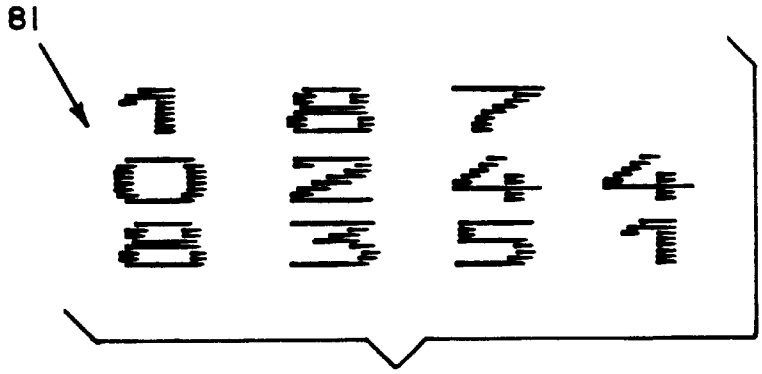
FIGS. 7(*a*), (*b*), and (*c*) together show a second method of printing a secure indicia including a pass where only the edges of the indicia numerics are printed.
Figure 7B:
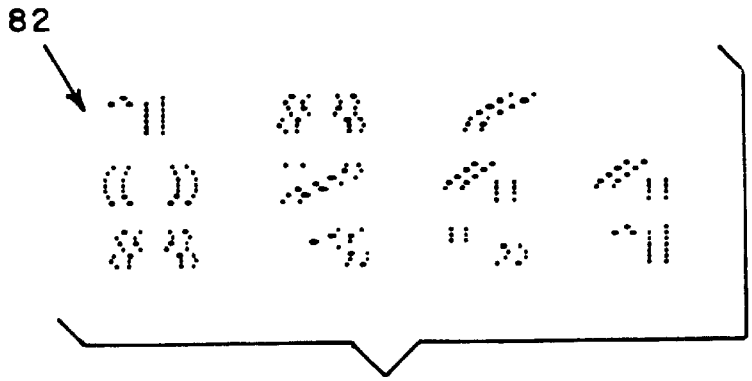
Figure 7C:
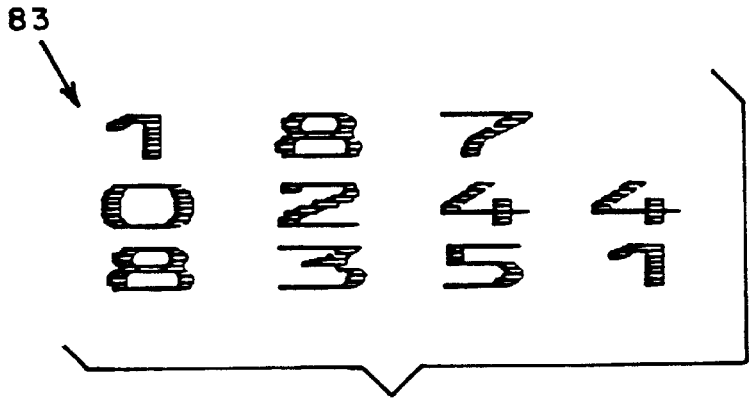

The concept of "touching-up" the numerics of the indicia image is shown in FIGS. 7(*a*), 7(*b*), and 7(*c*) where some of the numerics 81 of a typical indicia are shown. During the first pass of printing mechanism 9 (FIG. 7(*a*)) the numerics would be printed at 80 (vertical) by 480 (horizontal) dpi. During a second pass (FIG. 7(*b*)) only the outside edges 82 of the individual numerics are printed for enhanced OCR readability. The combination of the first and second passes precludes a numeric image 83 as shown in FIG. 7(*c*) which is OCR readable. Moreover, while additional dots can be added to the numerics during the second pass, the applicants have found that by just printing the outside edges of the numerics, the OCR read rate is maximized with the least amount of dots printed.

Figure 8A:
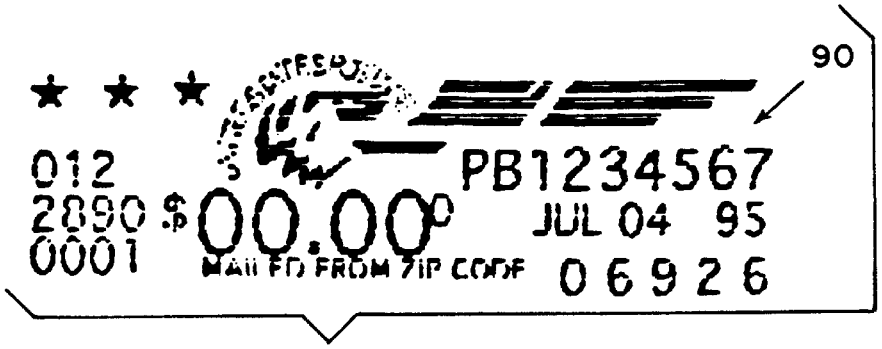
FIGS. 8(*a*), and (*b*), together show a third method of securely printing an indicia including a border.
Figure 8B:
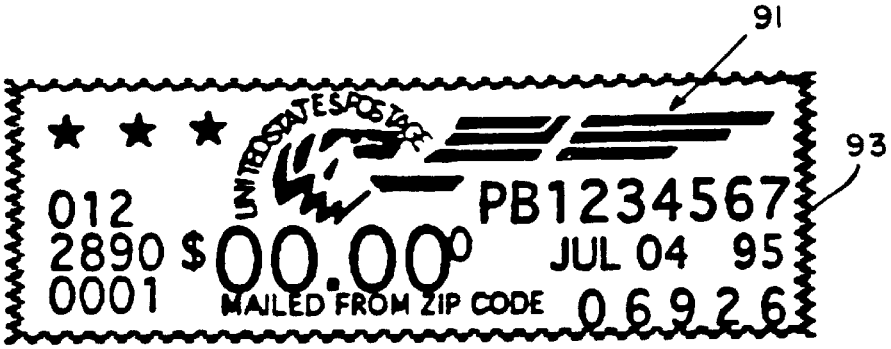

Referring to FIGS. 8(*a*) and 8(*b*), yet another method of printing a secure indicia is shown. In this embodiment a full indicia is printed during both first and second passes of the printing mechanism 9. The indicia 90 produced during the first pass has a dot density along the height of the indicia of 80 dpi while the indicia produced during the second pass also has a height density of *80* dpi resulting in a combined interlaced final indicia 91 having a height density of *160* dpi. However, during the second pass a distinctive border 93 is also printed. In the preferred embodiment the border 93 simulates the perforations of a postage stamp, although it may consist of another image that is sufficiently detailed so as to make reproduction by other means very difficult. Thus, the indicia image 90 produced during the first pass of printing mechanism 9 is readily identified as being an invalid indicia not only due to its low dot density but because it is missing the indicia border 93.

Figure 9A:
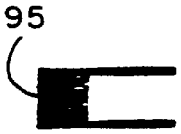
FIGS. 9(*a*), (*b*), and (*c*) together show a fourth method of securely printing an indicia including a symbol.
Figure 9B:
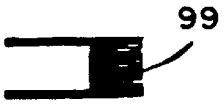
Figure 9C:
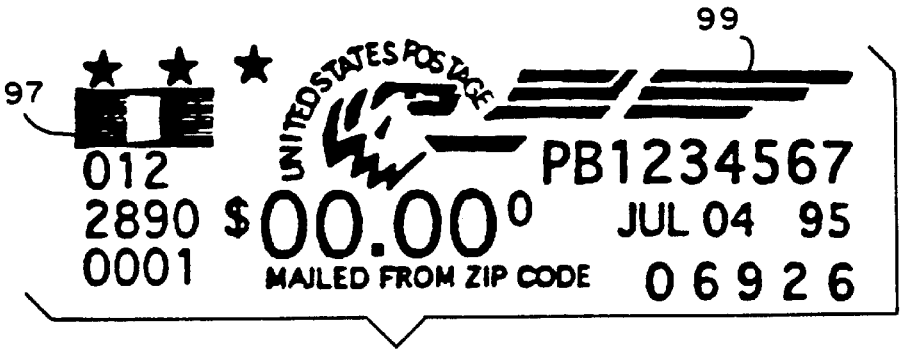

Yet another way of producing a secure indicia is reflected in FIGS. 9(*a*), 9(*b*), and 9(*c*). In this method, during a first pass of printing mechanism 9 a complete indicia image is printed having a height dot density of 80 dpi and an indicia length density of 480 dpi. Also included as part of the indicia image produced during the first pass is one-half 95 (FIG. 9(*a*)) of an easily identifiable symbol 97. During the shifted second pass of printing mechanism 9, another indicia image at 80 dpi by 480 dpi is printed and interlaced with the first indicia image to produce a complete indicia 99 at 160 dpi by 480 dpi. Moreover, during the second pass, the second one-half 99 (FIG. 9(*b*)) of the symbol 97 is produced to create the full symbol 99 at 80 dpi by 480 dpi. Thus, if a mailpiece having only the indicia and ½ of the symbol produced by either the first or second passes is processed at to the postal office, it is readily visually identifiable as being an invalid indicia since the entire symbol 97 has not been printed.

In another variant of the method described in connection with FIGS. 9(*a*), 9(*b*), and 9(*c*) above, the multipass check digit 67 (See FIG. 5) could also be used to distinguish between a valid and an invalid indicia. That is, the multipass check digit 67 would only be produced during one of the two passes of printing mechanism 9. Thus, the lack of a multipass check digit as part of the indicia provides an easy visual indication that the indicia is not valid.

Figure 10A:
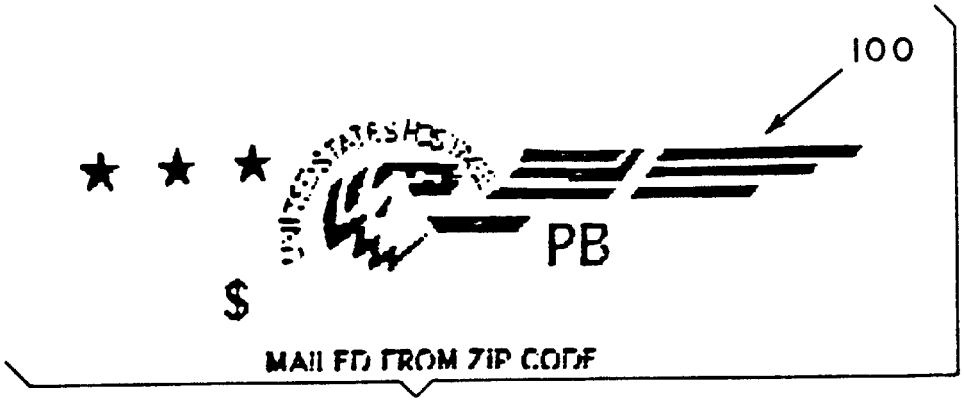
FIGS. 10(*a*), (*b*), and (*c*) show a fifth method of securely printing an indicia.
Figure 10B:
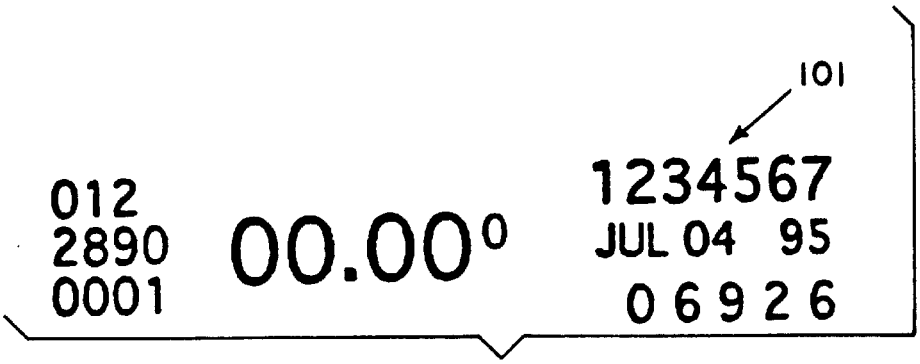
Figure 10C:
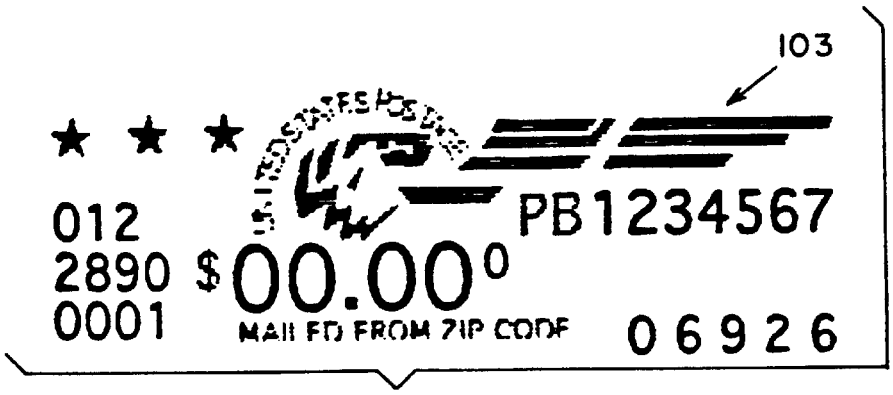

FIGS. 10(*a*), 10(*b*) and 10(*c*) show yet another embodiment for producing a secure indicia. In the embodiment of FIGS. 10(*a*), (*b*) and (*c*) the graphics may be printed during a first pass of printing mechanism 9 (for example from right to left) or on the second pass (right to left), while all of the numerics would be printed during both passes. Thus, for example, during the first pass the complete indicia including the graphics 100 and numerics 101 would be printed at 80 dpi by 480 dpi. Then, during the second pass just the numeric portions of the indicia would be printed so that the final interlaced indicia image would have graphics at 80 dpi by 480 dpi and numerics at a dot density of 160 dpi by 480 dpi. FIG. 10(*a*) shows just the graphics 100 printed during either the first or second passes while FIG. 10(*b*) shows the numerics 101 after two passes. FIG. 10(*c*) shows the final indicia 103 resulting from the two passes. Alternatively, during a first pass of printing mechanism 9, which for example is right to left, the numerics could be printed at 80 dpi by 480 dpi and during the return of the printhead from left to right and prior to the shift of the printhead in the indicia height direction the graphics could be printed at 80 dpi by 480 dpi. Subsequent to this, the printhead would be shifted and a second image of the numerics at 80 by 480 dpi would be produced moving from right to left thereby producing the final indicia image. By keeping the printing of the numerics in the same direction during each pass, it is easier to ensure OCR readability of the numerics.

What is claimed is:

1. A method for printing a postal indicia on a mailpiece comprising the steps of:

A) moving a printing mechanism and the mailpiece relative to each other during a plurality of passes; and B) printing with the printing mechanism at least a corresponding portion of the postal indicia during each of the plurality of passes, each of the corresponding portions being in overlapped relationship to the other corresponding portions so that the combined effect of the corresponding overlapped portions is a postal indicia which is detectable by a facer/canceler machine as a valid postal indicia;

wherein during no more than one of the plurality of passes is its corresponding portion of the postal indicia detectable by the facer/canceler machine as the valid postal indicia.

2. A method as recited in claim 1, wherein during no more than one of the plurality of passes is its corresponding portion of the postal indicia readable by optical character reader equipment.

3. A method as recited in claim 1, wherein printing is accomplished using fluorescent ink.

4. A method as recited in claim 1, wherein printing is accomplished using phosphorescent ink.

5. A method for printing a postage indicia including a predetermined symbol on a mailpiece, the predetermined symbol identifying the postal indicia as a valid indicia, the method comprising the steps of:

A) moving a printing mechanism and the mailpiece relative to each other during a plurality of passes;

B) printing with the printing mechanism at least a corresponding portion of the postage indicia during each of the plurality of passes, each of the corresponding portions being in overlapped relationship to the other corresponding portions, and wherein the predetermined symbol is only printed during one of the plurality of passes and the combined effect of the corresponding overlapped portions is the valid postal indicia.

6. A method as recited in claim 5, wherein the symbol is a multipass check digit.

7. A method as recited in claim 5, wherein the symbol is a border of the valid postal indicia.

8. A method as recited in claim 7, wherein the border is in a form of edges of a stamp.

9. A method for printing a postage indicia including a predetermined symbol on a mailpiece, the predetermined symbol identifying the postal indicia as a valid indicia, the method comprising the steps of:

A) moving a printing mechanism and the mailpiece relative to each other during a plurality of passes;

B) printing with the printing mechanism at least a corresponding portion of the postage indicia during each of the plurality of passes, each of the corresponding portions being in overlapped relationship to the other corresponding portions, and wherein only a portion of the predetermined symbol is only printed during anyone of the plurality of passes and the combined effect of the corresponding overlapped portions is the valid postal indicia.

10. An apparatus for printing a postal indicia on a mailpiece for individual postage transactions comprising:

an accounting device which accounts for the value of each postage transaction;

a printing mechanism mounted so that the mailpiece and printing mechanism are moveable relative to each other during a plurality of passes; and means for controlling the printing mechanism, during each postage transaction, to print at least a corresponding portion of the postal indicia during each of the plurality of passes, each of the corresponding portions being in overlapped relationship to the other corresponding portions so that the combined effect of the corresponding overlapped portions is a postal indicia which is detectable by a facer/canceler machine as a valid postal indicia;

wherein during no more than one of the plurality of passes is its printed corresponding portion of the postal indicia detectable by the facer/canceler machine as the valid postal indicia thereby ensuring that for each postage transaction no more than one of the valid postal indicia is printed.

11. An apparatus as recited in claim 10, wherein the printing mechanism is an ink jet printer.

* * * * *